United States Patent [19]

Benson

[11] Patent Number: 4,483,233

[45] Date of Patent: Nov. 20, 1984

[54] COMBINED GUITAR AND BASS GUITAR HAVING EIGHT STRINGS

[76] Inventor: Ron Benson, 6757 Hollywood Blvd., Hollywood, Calif. 90028

[21] Appl. No.: 431,395

[22] Filed: Sep. 30, 1982

[51] Int. Cl.[3] ..... G10D 1/08

[52] U.S. Cl. ..... 84/263; 84/267; 84/312 R

[58] Field of Search ..... 84/263, 267, 295, 312 R, 84/314 R, 173

[56] References Cited

U.S. PATENT DOCUMENTS

| | | | |
|---|---|---|---|
| 357,168 | 2/1887 | Barnwell | 84/314 R |
| 2,897,709 | 8/1959 | McCarty et al. | 84/1.15 |
| 2,964,985 | 12/1960 | Webster | 84/1.15 |
| 3,443,467 | 5/1969 | Richards | 84/312 R |
| 3,868,880 | 3/1975 | Chapman | 84/267 |
| 4,377,101 | 3/1983 | Santucci | 84/1.16 |

*Primary Examiner*—Lawrence R. Franklin

*Attorney, Agent, or Firm*—Wagner & Bachand

[57] ABSTRACT

A combined guitar and bass guitar employing a common body, neck and finger board and more significantly employing two common strings to provide both instruments employing a total of eight strings.

6 Claims, 5 Drawing Figures

COMBINED GUITAR AND BASS GUITAR HAVING EIGHT STRINGS

BACKGROUND OF THE INVENTION

Through the years with the tremendous expansion and interest in the guitar as a lead instrument in small groups and even with symphony orchestras there has been a comparable expansion in the use of the bass guitar as background. Most guitar players become, to a degree, proficient in the playing of both instruments. This necessitates the carrying of two instruments. The typical solution is for a group to include at least one guitar and one bass guitar player.

In the past there has been attempts to make double instruments. These are typified by the instruments described in the comprehensive book *Guitars* by Tom and Mary Anne Evans, copyright 1977, Paddington Press, Ltd., New York, N.Y. Disclosed there on page 163 is a nine string guitar employing six regular strings and three separate bass strings to allow playing of lute music. On page 165, a ten string guitar of Narcisco Yepes is disclosed. A double necked guitar of John McLaughlin is disclosed on page 429 of the Evans' "Guitars" book and in U.S. Pat. No. 1,183,369.

Typical of these devices is the fact that a virtually double size instrument requires a much larger neck or two necks and because of their general cumbersome nature have not been generally accepted. Other approaches employing a dual set of strings on different levels or boards have likewise not been generally accepted as practically playable by a professional player. Representative of these types of instruments are the instruments disclosed in U.S. Pat. Nos. 469,548; 497,939; 3,392,618; 3,398,622 and 3,783,731.

BRIEF DESCRIPTION OF THE INVENTION

I have been playing both guitar and bass guitar for many years and have noted each of the problems set forth above. It became clear to me that since the two instruments can be tuned to play the common notes G and D, which are the two lowest notes on the guitar scale and the higher two notes on the bass scale, that two strings can be used in common and that with an eight string guitar using the six normal strings of notes D, A, F, C, G and D, and the bottom two strings tuned to A and E, that a truly combined bass guitar can be achieved. I have done so with only a slight increase in overall weight of the instrument and width of the neck.

I have further found that by combining the two instruments into one that the following unforeseen advantages occur:

the tonal qualities of the bass and guitar arising from the guitar body are the same due to the use of the same guitar body. Tuning the instrument is faster and more uniform than that of two separate instruments. Costs related to the purchase, maintenance and travel is considerably lower than of both a guitar and a bass; In situations where space is limited both the size of the band and extra instrument space can possibly be reduced. Lastly the utilization of this combined instrument provides a unique musical effect when both bass and guitar are used together and the guitarist accompanys himself.

DETAILED DESCRIPTION OF THE INVENTION

Figure 1:
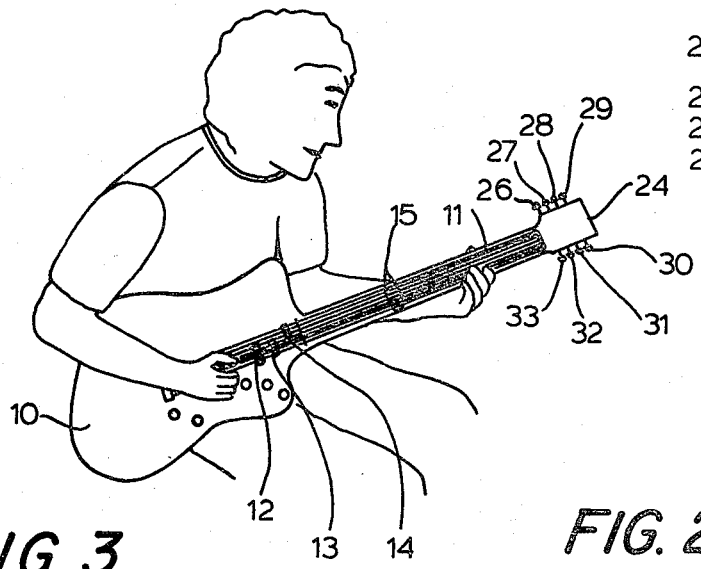
FIG. 1 shows a guitarist playing a guitar embodying the invention.

As a result of my need for a combined guitar/bass guitar I have developed the instrument disclosed in normal use in FIG. 1 wherein the player is holding a combined instrument 10 on his knee in the normal playing position with his left hand on the fingerboard 11 and his right adjacent to the sound pickup which may be the sounding board and opening of an acoustic guitar or in this case, a plurality of an electro-magnetic or other guitar pickups 12, 13 and 14.

Figure 2:
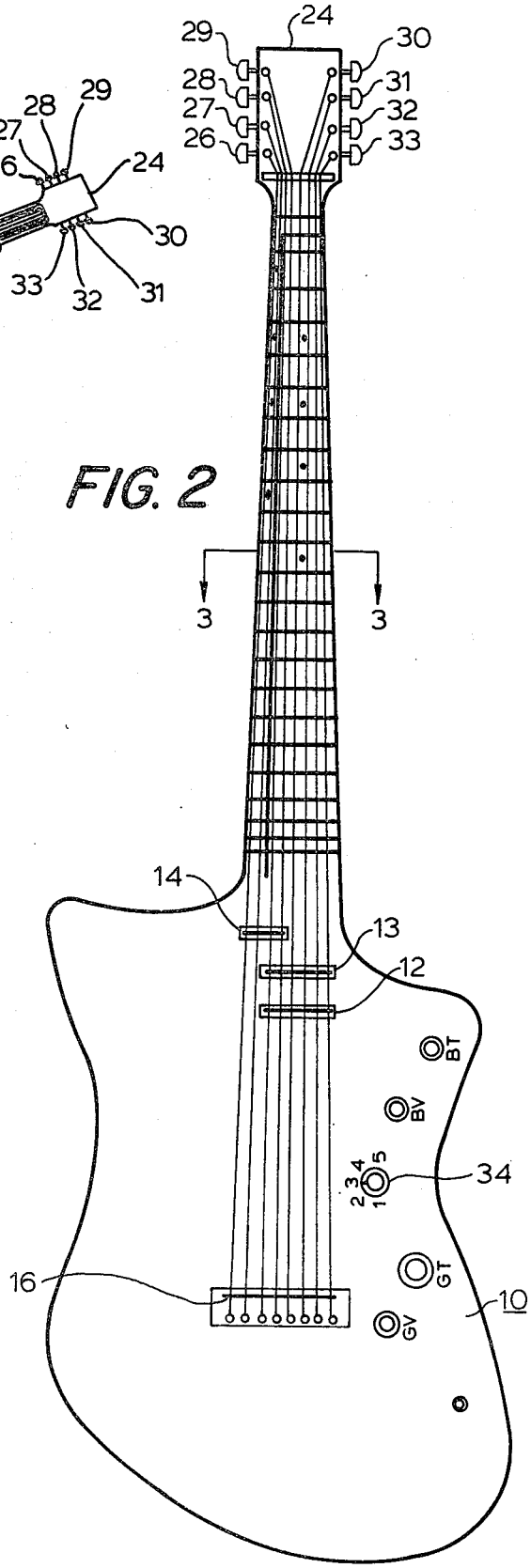
FIG. 2 is a front view of said guitar.
Figure 5:
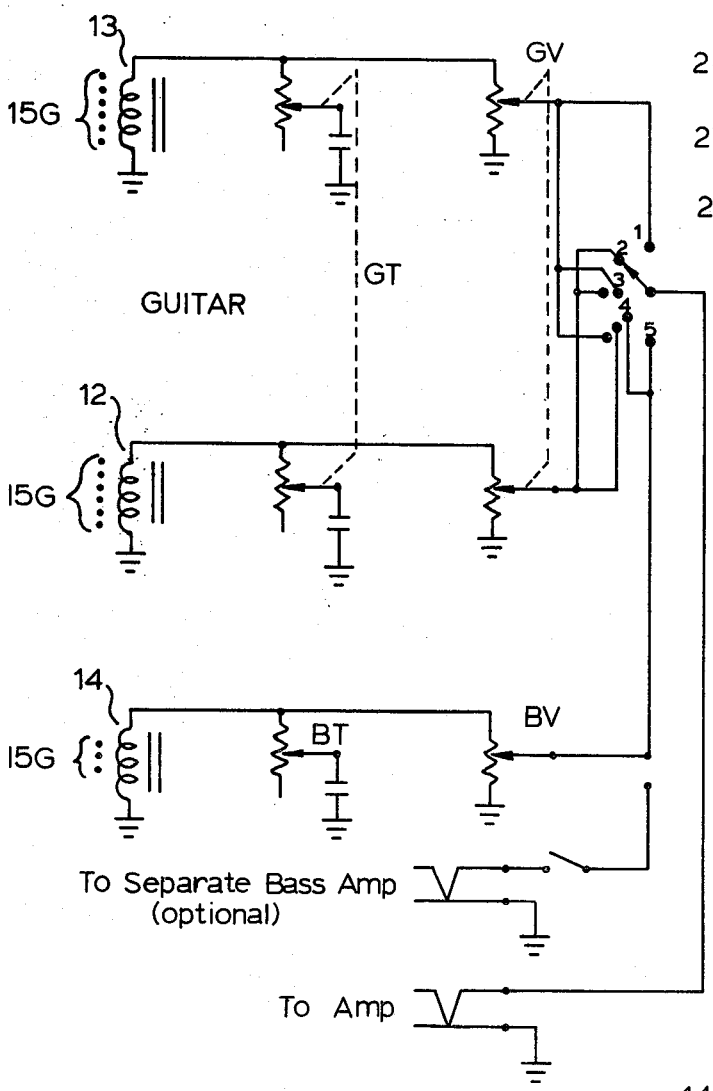
FIG. 5 is a control circuit for the guitar.

It should be noted in FIG. 1 and better in FIG. 2 that the instrument bears a total of eight strings 15, all positioned side-by-side and extending from the bridge 16 to the nut 20 and on to the individual tuning machines 26–33 on the head 24. The strings 15 are positioned approximately equally spaced. In this case, three electro-magnetic pickups 12, 13 and 14 are shown, two, 12 and 13 below the upper six strings and extending under the bottom two guitar strings, as well. Thus, the pickups 12 and 13 are so positioned to pickup the sound of the first six strings while the pickup 14 is positioned to pick up sound emanating from the last two of the guitar strings and the remaining strings constituting the bass string set. Note particularly that the instrument includes five controls and a pair of volume controls—one for the guitar array GV and the other BV for the bass array. Individual tone controls GT and BT are also located on the guitar body in any position convenient to the player's right hand. A five position switch 34 controls the operation of the guitar as follows:

| Position | Pickups Energized |
|---|---|
| 1 | Guitar Front (13) |
| 2 | Guitar rear (12) |
| 3 | Guitar both (12 and 13) |
| 4 | Guitar and Bass (12, 13 and 14) |
| 5 | Bass only (14) |

Figure 3:
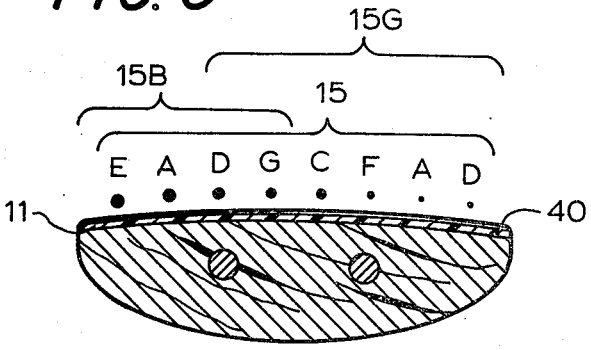
FIG. 3 is a cross-section of the neck of said guitar taken along line 3—3 in FIG. 2 which shows the tuning of the strings.

The distribution of the strings across the fingerboard is illustrated in FIG. 3 which is a sectional view across the neck of the instrument at 3—3 of FIG. 2. The preferred shape of the neck is a modified egg shape. The finger or fretboard 11 is slightly curved as are the frets represented by the fret 40. Note that the strings 15 are relatively evenly spaced so that all eight strings constitute a single array and no abrupt shifting of the players hands is required either for fingering or picking.

Figure 4:
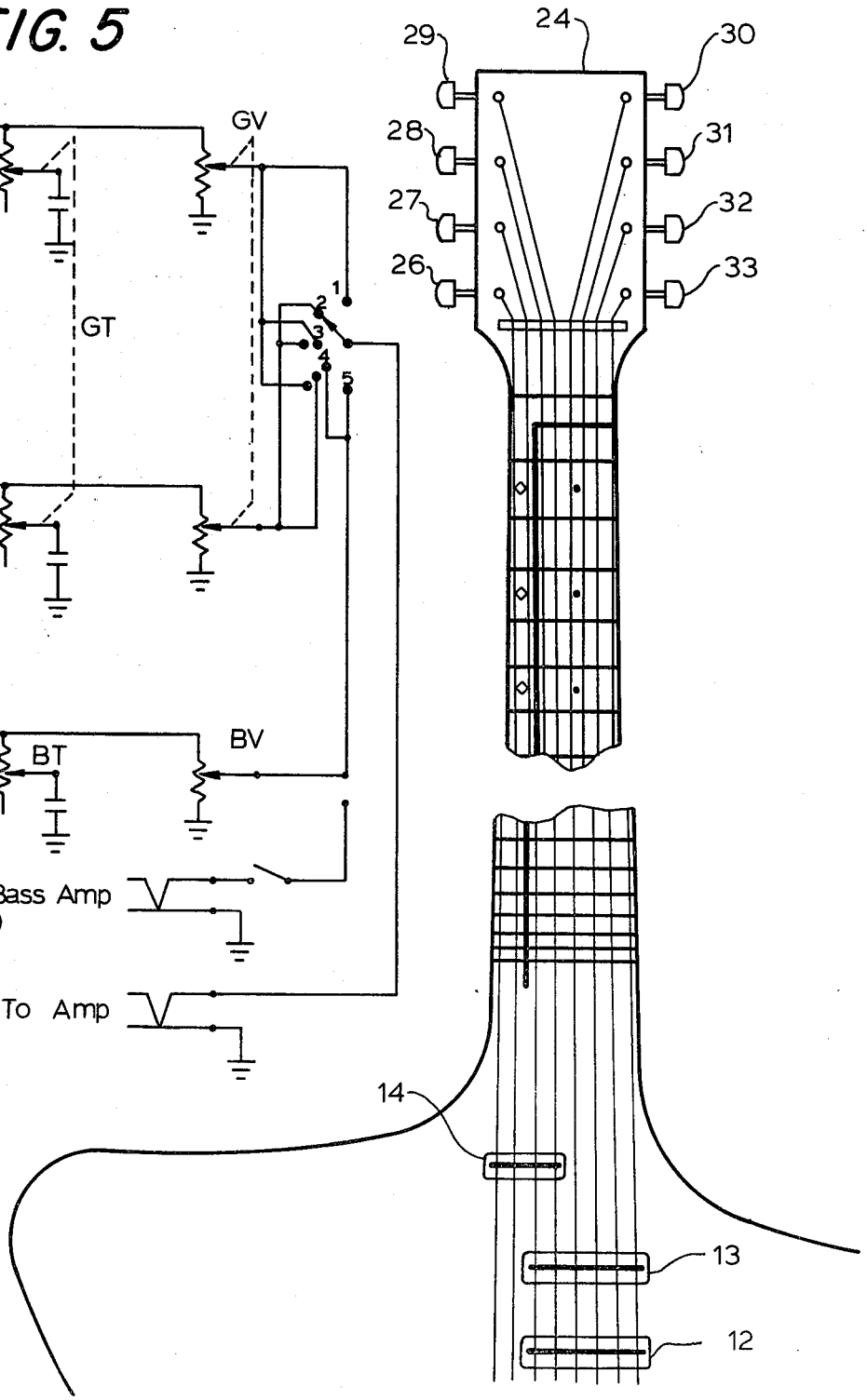
FIG. 4 is a detailed view of the fingerboard markings.

The fingerboard is modified to the extent best illustrated in FIG. 4. A divider marker 40 runs longitudinally between the lower most sixth and seventh strings, identified as A and E in FIG. 3. The marker 40 also divides the keyboard between the first and second fret 41 and 42 thereby defining the normal guitar fret board. Although the instrument need not include this marker 40 to be playable, it definitely aids the player in identifying the guitar portion of the fret board.

SUMMARY

This invention provides the following advantages to the player:

1. Expanded the range of the guitar. It is extended by 2 frets, allows open string chords down to D rather than the normal open key of E. Without restricting the upper range of the guitar.

2. The player may shift from guitar to bass or reverse with no guitar finger movement than normal playing.

3. Both instruments are more simply maintained in tune.

4. Virtually instantaneous switching from guitar to bass or back.

5. Bass effects can be added to standard guitar music or vice versa employing a single player.

6. The common problem of relocating one's fingers on the fret board upon shifting from guitar or bass while playing is eliminated.

7. One person can simultaneously play both guitar and bass music.

I claim:

1. A guitar of the type employing a body, a neck, and a plurality of strings, the improvement comprising: said plurality of strings comprising eight strings tuned in ascending order from a bass note to a treble note, the four adjacent strings which include said bass note being tuned proportional to the standard ascending bass scale of E, A, D, and G, and the six adjacent strings which include said treble note being tuned proportional to the standard ascending guitar scale of E, A, D, G, B, and E, the top two strings of said four strings being the bottom strings of said six strings, whereby a guitarist can play said four strings in the manner of a bass guitar and said six strings in the manner of a conventional six stringed guitar.

2. The guitar of claim 1 wherein the tunings of said eight strings are E, A, D, G, C, F, A, and D.

3. The guitar of either claim 1 or claim 2 wherein said eight strings are equally spaced in the playing region, whereby said guitarist may play the guitar by normal fingering.

4. The guitar of either claim 1 or claim 2 wherein the fingerboard of the guitar includes markings segregating said six strings from the remaining two strings.

5. The guitar of either claim 1 or claim 2 wherein in the fingerboard includes markings segregating a number of frets in the guitar string region from the remainder of the fingerboard.

6. The guitar of either claim 1 or claim 2 including marking means defining an area encompassing said six strings and the first or highest frets on the fingerboard.

* * * * *